US006543505B1

(12) United States Patent
Harte

(10) Patent No.: US 6,543,505 B1
(45) Date of Patent: Apr. 8, 2003

(54) EMPTY PACKAGE DETECTOR FOR LABELING APPARATUS

(75) Inventor: James R. Harte, Shawnee, KS (US)

(73) Assignee: Koch Equipment, LLC, Kansas City, MO (US)

( * ) Notice: Subject to any disclaimer, the term of this patent is extended or adjusted under 35 U.S.C. 154(b) by 0 days.

(21) Appl. No.: 09/553,837

(22) Filed: Apr. 21, 2000

(51) Int. Cl.[7] ..... B65H 26/00

(52) U.S. Cl. ..... 156/350; 156/362; 156/363; 156/540; 156/556

(58) Field of Search ..... 156/360, 361, 156/362, 363, 368, 541, 542, 350, 540, 556

(56) References Cited

U.S. PATENT DOCUMENTS

| | | | | |
|---|---|---|---|---|
| 3,436,294 A | | 4/1969 | Marano | |
| 4,025,382 A | * | 5/1977 | Del Rosso | 156/497 |
| 4,132,583 A | | 1/1979 | Hodgson | |
| 4,214,938 A | | 7/1980 | Figg | |
| 4,303,461 A | | 12/1981 | La Mers | |
| 4,324,608 A | | 4/1982 | Klinger | |
| 4,585,506 A | | 4/1986 | Matsuguchi | |
| 5,300,160 A | | 4/1994 | Wilson et al. | |
| 5,400,838 A | * | 3/1995 | Schjerven et al. | 141/174 |
| 5,410,246 A | | 4/1995 | Cornwall et al. | |
| 5,410,488 A | | 4/1995 | Andersen, III | |
| 5,421,946 A | | 6/1995 | Flaig | |
| 5,498,958 A | | 3/1996 | Tu et al. | |
| 5,597,440 A | | 1/1997 | Pecha | |
| 5,650,730 A | | 7/1997 | Herbst, Jr. | |
| 5,660,676 A | | 8/1997 | Brooks | |
| 5,725,717 A | | 3/1998 | Harte et al. | |
| 5,767,672 A | | 6/1998 | Guichard et al. | |
| 5,801,340 A | | 9/1998 | Peter | |
| 5,888,343 A | | 3/1999 | Olson | |
| 5,895,555 A | | 4/1999 | Van Den Bergh | |
| 5,954,913 A | | 9/1999 | Wurz et al. | |
| 5,966,908 A | * | 10/1999 | Philipp et al. | 53/540 |
| 6,014,022 A | | 1/2000 | Demma et al. | |
| 6,024,149 A | | 2/2000 | Bernhard et al. | |
| 6,043,774 A | | 3/2000 | Singh et al. | |
| 6,295,881 B1 | * | 10/2001 | Stewart et al. | 73/866.5 |

FOREIGN PATENT DOCUMENTS

| | | |
|---|---|---|
| FR | 2719020 | 10/1995 |

* cited by examiner

*Primary Examiner*—Richard Crispino
*Assistant Examiner*—Cheryl N. Hawkins
(74) *Attorney, Agent, or Firm*—Jennifer H. Hammond; Sonnenschein Nath & Rosenthal

(57) ABSTRACT

A method and apparatus for communicating with a multiple lane labeling machine such that the labeling machine will only dispense and place labels on packaged articles. The present invention comprises a labeling machine having sensors positioned in front of the label transport, which positions the labels on the packaged articles. These sensors are preferably positioned directly in front of the label transport over the row of articles preceding the transporter and operate to detect the presence and absence of packaged articles and their content. Thus, if a package is absent from a row or does not contain product the sensors alert the labeling machine of the absence of an article so that the labeler does not dispense a label for a missing article or empty package.

10 Claims, 7 Drawing Sheets

EMPTY PACKAGE DETECTOR FOR LABELING APPARATUS

FIELD OF THE INVENTION

This invention relates to a method and apparatus for detecting empty or absent packages on a packaging machine system to prevent the dispensing of labels on empty or absent packages. In particular, the method and apparatus comprises a labeling apparatus having proximity sensors mounted thereto to detect empty or absent packages and to communicate such information to the labeling dispenser to prevent the unnecessary dispensing of labels.

BACKGROUND OF THE INVENTION

In a variety of food and medical packaging operations, a packaging system is utilized .commonly referred to as a horizontal form, fill, and seal packaging machine. These systems index in a start and stop type operation and package an array of products each cycle. And such as operations where a food product is packaged, it is desirable to place labels on the packages. The packager may place the labels manually on the packaging film before the package is filled with product or after the article is packaged. Manual label placement is costly and slow. Thus, packagers have found automated apparatus useful in placing labels on the packaging.

Typically, labels are either (1) placed on packaging film that is then later used to package an article or (2) placed directly on the packaged article. An example of a device that places labels directly on packaging film is described in Harte et al. U.S. Pat. No. 5,725,717. An example of a device that places labels directly on the packaged article is found in Wurz et al., U.S. Pat. No. 5,954,913.

To accelerate the process of placing the labels on the packaging film or the packaged articles, labeling devices are designed to place labels on an array of packages or place several labels across the width of the packaging film. In these devices, the labeling apparatus is perpendicular to the movement of the film or the packaged articles (as illustrated by FIG. 1 and U.S. Pat. No. 5,725,717). Such labeling devices can be designed to apply labels to package arrays varying from a minimum of one row by two tracks, to twenty-four rows by twenty-four tracks, and possibly more.

Labelers designed to place labels on an array of packages will dispense the labels across the index of the packaging machine. The labels are dispensed across a transport unit that extends outward and perpendicular to the packaging machine system. The transport unit spaces the labels appropriately to align the labels with the tracks of the packaging machine system, such that the labels can be placed directly on the packaged articles on the tracks of such system.

To place the labels on these packages, the transport unit has tamping plates that press the labels on the packaged articles. Even when a package is empty, the labeler will place the label on the empty package, thereby wasting labels.

Labeling machines of this type may be mounted upright labeling the top of the package or in an inverted position underneath the packaging machine labeling the bottom of the product. The label machine typically holds the loose labels against a transport unit through vacuum. The transport unit transports and aligns the labels across the row of articles. When a package in the array is empty and the labeling machine is inverted, the labeler would normally attempt to label the entire array but the empty package in the array is generally collapsed and will not accept the label. Then the labels drops back onto the labeling machine which eventually will jam the labeling machine and require the entire line to be stopped to remove loose labels.

Accordingly, there is a need for a method and apparatus that detects when a container is empty or when an article is absent and communicates such information to the labeling apparatus to prevent the labeling apparatus from unnecessarily dispensing labels.

SUMMARY OF THE INVENTION

Accordingly, the principle object of the present invention is to provide a method and apparatus for communicating with a labeling machine such that the labeling machine will only dispense and place labels on packaged articles and will not dispense labels onto empty packages or packages missing from the stream of packaged articles.

In the present invention, sensors are positioned in front of the labeling transporter, which positions the labels on the packaged articles. These sensors are preferably positioned directly in front of the transporter over the row of articles preceding the transporter and operate to detect the presence and absence of packaged articles and their content. Thus, if a package is absent from a row or does not contain product, the sensors can alert the labeling machine so that the labeler does not dispense a label for that missing article or empty package.

The present invention utilizes capacitive sensors, such as those sold by Turck, Inc., and is designed primarily for use in connection with articles packaged in packaging film, such as food products. When used with other types of packaging film, capacitive sensors would likely only detect the complete absence of a package and not empty packages. While detecting the absence of a package still provides an advantage to typical array labelers, the full advantages of the present invention are not recognized when used with other types of packaging film. Sensors, however, are designed to detect a wide-variety of items. Thus, one skilled in the art may be easily able to vary the type of sensors used in connection with the present invention to allow the detection of the absence of content packaged in different types of packaging material.

The present invention and other objects, advantages and variations thereof will be clarified in the following description of the preferred embodiment in connection with the drawings, the disclosure and the appended claims, wherein like reference numerals represent like elements throughout.

DESCRIPTION OF THE PREFERRED EMBODIMENT

Figure 1:
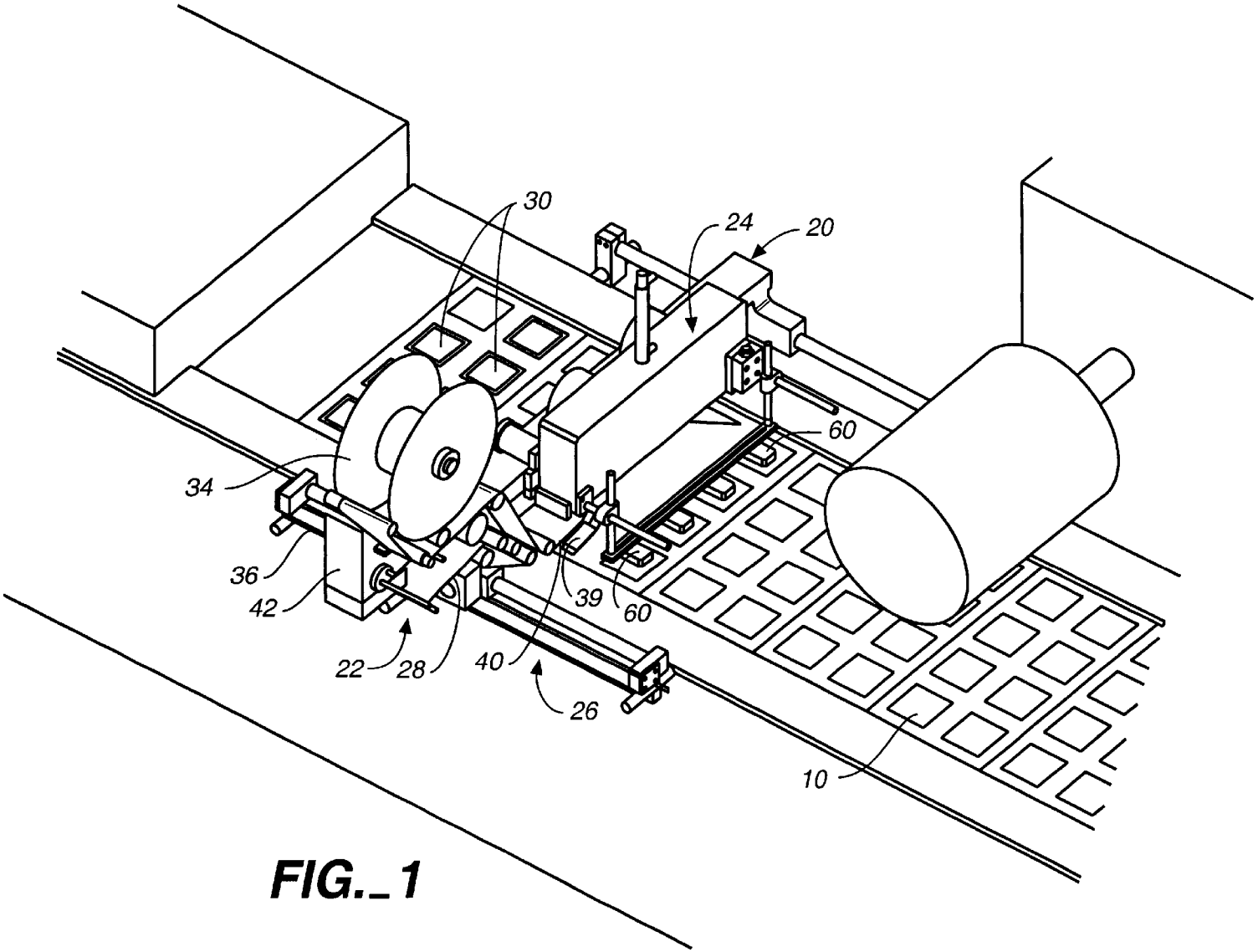
FIG. 1 is a perspective view of a labeling machine mounted on a packaging machine system and having proximity sensors attached thereto for detecting empty packages and absent articles.
Figure 2:
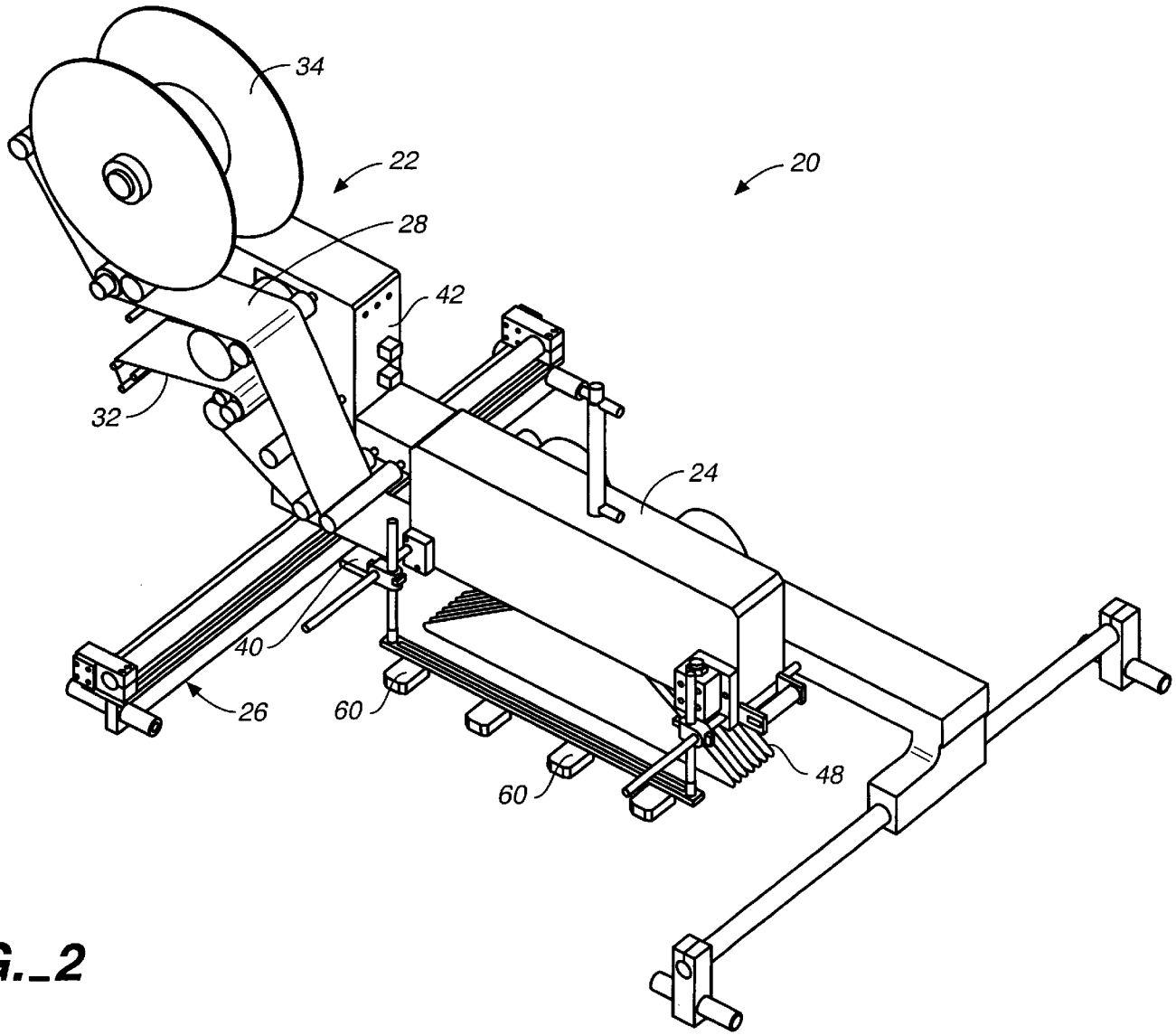
FIG. 2 is a perspective view of a labeling machine having proximity sensors attached thereto.
Figure 3:
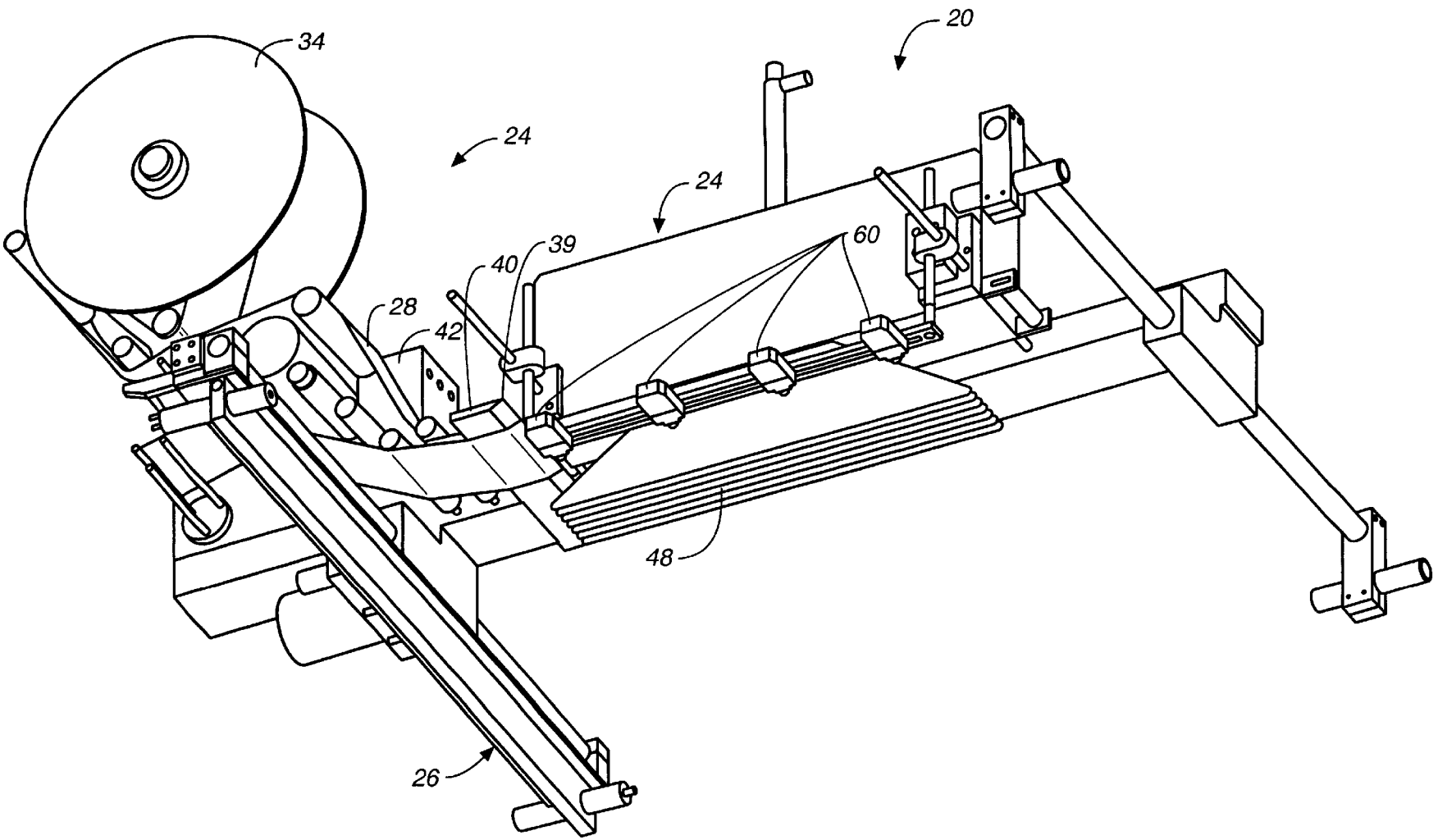
FIG. 3 is a bottom view of the labeling machine with proximity sensors illustrated in FIG. 2.
Figure 4:
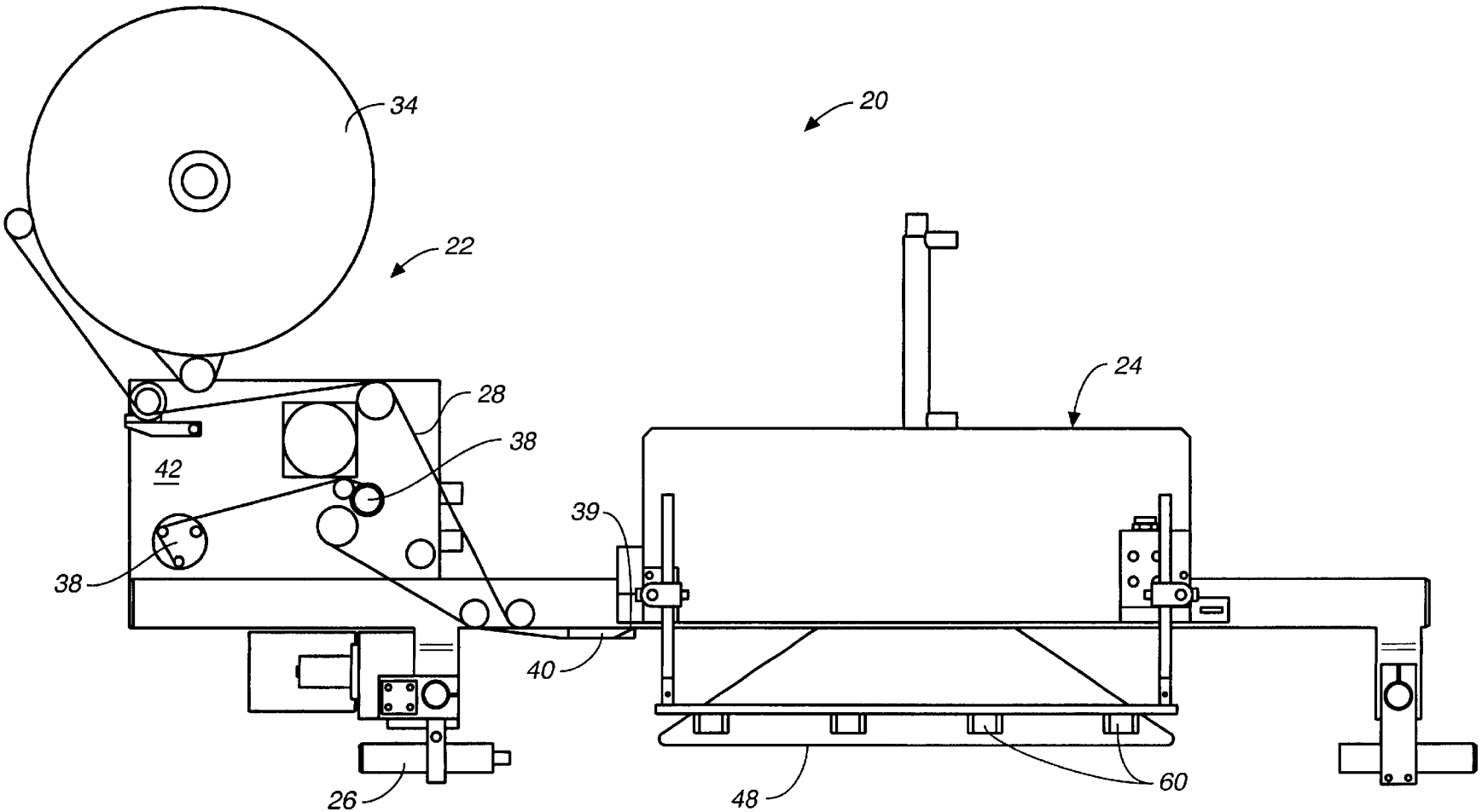
FIG. 4 is a plan view of the labeling machine with proximity sensors illustrated in FIG. 2.
Figure 5:
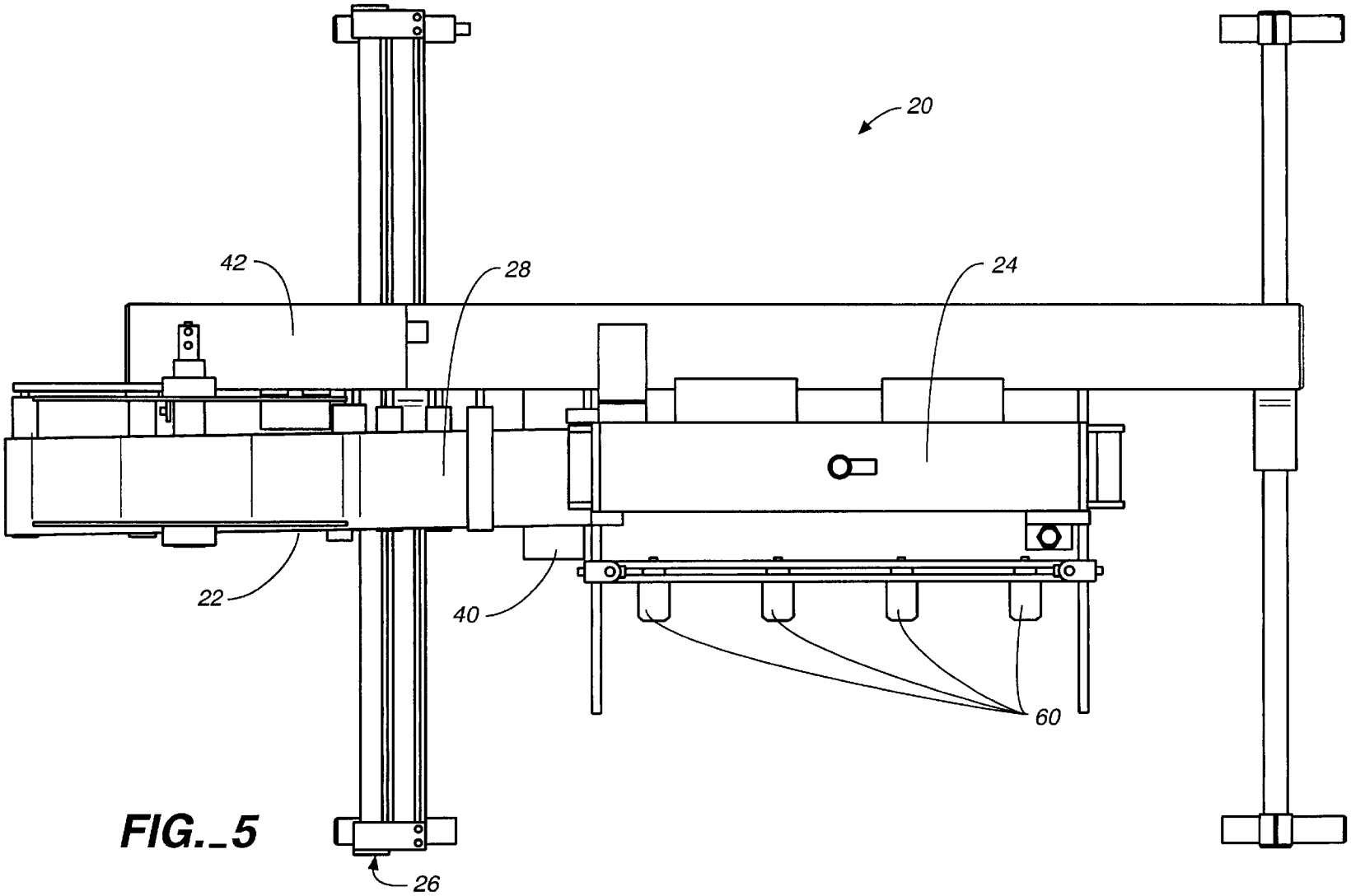
FIG. 5 is a top view of the labeling machine with proximity sensors illustrated in FIG. 2.
Figure 6:
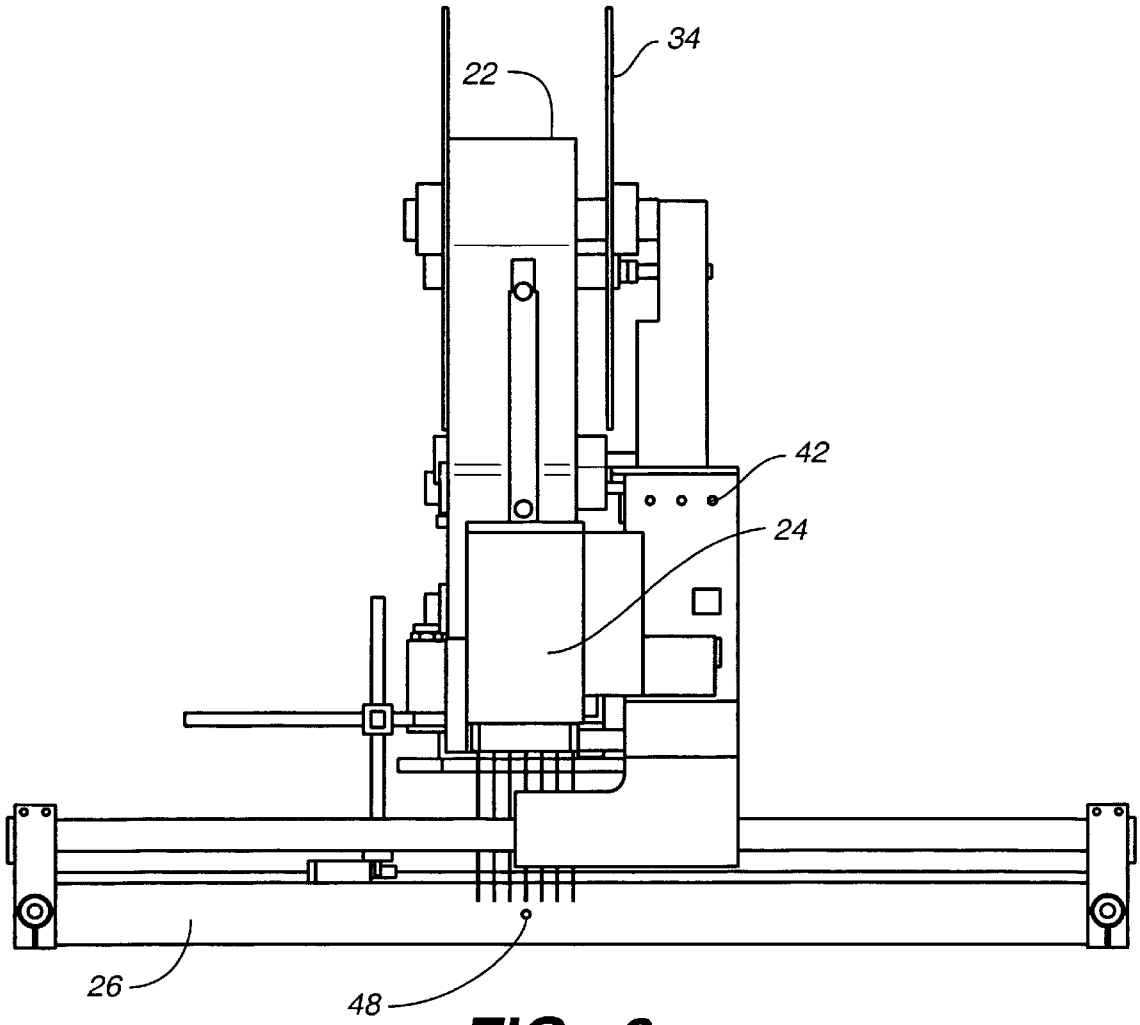
FIG. 6 is a side view of the labeling machine with proximity sensors illustrated in FIG. 2.

As seen in FIG. 1, the present invention, in general terms, comprises a labeling machine (also referred to herein as a "labeler") having proximity sensors 60 mounted thereon for communicating to the labeling machine 20 either (1) the presence of an empty package 10 or (2) the absence of a package 10 expected to be present for labeling. The labeling machine 20 utilized in the present invention and shown in the attached Figures is known in the art. The particular machine 20 illustrated in the Figures is sold by Koch Supplies as the Crossweb™ Package Labeler. Although other labeling machines 20 can be adapted for use with the proximity sensors 60 described herein, the preferred embodiment utilizes the Koch Crossweb™ Package Labeler.

Additionally, while the present invention can use an in-line labeler, i.e., single article labeler 20, the present invention is more advantageous when used in connection with web labelers, or labelers 20 that are designed to place labels 30 on an array of packages 10, as illustrated in FIG. 1. Furthermore, the present invention can be used in connection with both upright and inverted machines 20, the upright machines 20 place labels on the top of the packages 10 while the inverted machines 20 place labels on the underside of the packages 10.

To fully understand the scope and nature of the present invention, one must first appreciate the operation of a web labeler 20, such as the Koch Crossweb™ Package Labeler. A typical web labeler 20 is positioned perpendicular to the movement of the articles 10 and extends either above or beneath the packaged articles 10, depending upon the positioning of the web labeler 20.

A typical labeler 20 includes a label dispensing mechanism 22 and a label transport and tamping mechanism 24 (also referred to herein as a "transporter"), each driven by a stepper motor (not shown) and a control unit (not shown). In the present invention, each mechanism 22 and 24 is controlled by a separate microprocessor, in a master-slave operation, with the label transport and tamping mechanism 24 operating as the master and the label dispensing mechanism 22 operating as a slave. Thus, the label transport mechanism 24 calls the label dispensing mechanism 22 when the transport mechanism 24 needs a label 30.

Optionally, the labeler 20 may also include a shifting unit 26 that moves the label transport 24 and dispensing mechanism 22 forward with each cycle of operation. Like the label dispensing mechanism 22, the shifting unit 26 is also driven by a step motor, controlled by its own microprocessor and operates as a slave, being called by the microprocessor of the label transport and tamping mechanism 24.

The label transport 24 includes a belt (not shown) through which a vacuum force is applied. The belt receives a series of labels 30, at predetermined positions along the belt, from the label dispensing mechanism 22 and holds the non-adhesive side of the labels 30 against the belt using the vacuum force. The belt then positions the labels 30 over a corresponding row of articles 10 and a tamper bar 48 then removes the labels 30 from the belt and places the labels 30 on the row of articles 10. The packaging machine then either moves the next row of articles 10 under the label transport 24 or the shifting unit 26 positions the label transport 24 over the next row of articles 10 as it dispenses a new series of labels 30.

As seen in FIG. 1, the label dispensing mechanism 22 contains a label roll 34 and a dancer 36 that applies tension to the label web 28, ie., the plurality of labels 30 with the adhesive side of the labels 30 placed against a web backing 32. The label web 28 is then fed around rollers 38. A stepper motor, or other like motor, pulls the labels 30 around a peelbar 40 to dispense the labels 30 onto the label transport and tamping mechanism 24. The web backing 32, after the labels have been removed, is then delivered to a take-up roller 38 that applies tension to the label web backing 32.

To assist in transferring the labels 30 to the transport and tamping mechanism 24, the labeler dispensing mechanism 22 also comprises a peelbar 40 and label scanner 42 for sensing the edges of the labels 30 and determining the width of the labels 30. The peelbar 40 is mounted on the label dispensing mechanism 22 at the interface between the label dispensing mechanism 22 and the label transport and tamping mechanism 24. The peelbar 40 includes an edged surface 39 at which the labels 30 are separated from the backing web 32 by the backing web 32 being pulled around the edged surface 39 by the step motor.

Sensors (not show) on the label scanner 42 are used to detect the leading edge of the label 30 Based upon the position of the leading edge of the label 30, the system adjusts the speed of the label web 28 by controlling the step motor that drives the label dispensing mechanism 22.

The label dispensing mechanism 22 also preferably includes an airstream device (not shown) for assisting the transfer of the label 30 onto the label transport mechanism 24. The airstream device may create a short pulse of air at the desired time, or provide a continuous airstream to assist with the transfer of the label 30 onto the belt of the label transport 24.

As discussed above and illustrated in FIGS. 2–6, the label transport and tamping mechanism 24 interfaces with the label dispensing mechanism 22 to receive the labels 30 from the label web 28. The label tort 24 receives the labels 30 from the edge surface 39 of the peel bar 40. The label transport and tamping mechanism 24 is driven by a step motor, controlled by a microprocessor and operates as the master of the labeler 20. The label transport and tamping mechanism 24 comprises several rotating vacuum belts around a roller 38. The belts are evenly spaced apart with tamper blades 48 positioned between the belts for removing the labels 30 from the belts. Within the label transport 24 is a vacuum belt for applying vacuum force through the belt. The vacuum belts include a plurality of holes through which a vacuum force is applied.

By using sensors on the label scanner 42 and the appropriate pre-programmed variables, the label transport 24 is able to determine the correct positioning of the labels 30 on the vacuum belts such that the labels 30 can be positioned at the appropriate positions over the packaged articles 10. Based upon the information from the sensors on the label scanner 42 and the preprogrammed variables, the label transport 24 is programmed to know the placement of each label 30 on the transport belt, the width of each label 30, the amount of space between each label 30 and the number of labels to be dispensed per row. Thus, based on these conditions, the label transport 24 is able to calculate the move profiles of the transport belt in order to place the labels 30 on the belt at the appropriate locations.

The label transport executes a series of discrete moves to transfer the label 30 on to the transport belt and to create the appropriate spacing between the label 30. The belt decelerates to receive labels 30 and then accelerates to create the proper spacing between the labels 30. Without the use of the proximity sensors 60, as further described below, labeling machines 20, similar to the Koch Crossweb™ Package Labeler, are programmed to dispense labels at appropriate spacing, without regard to whether a packaged article 10 is in fact present or whether the package 10 is empty. While the in-line labelers do prevent the labeling of missing packages, the in-line labelers do not prevent the labeling of empty packages and thus, the present invention, while primarily designed for array systems, adds some advantage to in-line operations.

In the present invention, sensors 60 are positioned in front of the label transport 24, preferably directly in front of the transporter 24 and over the row preceding the transporter 24 (as seen in the attached Figures), to detect the presence and absence of packaged articles 10 and their content. Thus, if a package 10 is absent from a stream of articles or does not contain product, the sensors 60 can alert the labeler 20 so that the labeler 20 does not dispense a label 30 for that missing article 10 or empty package 10.

For example, in a typical array packaging system, such as the system shown in FIG. 1, each row of packaging contains four articles 10. These articles 10 can be advanced toward the labeler 20 one row at a time or can advance in two or more rows at a time, in which case the shifting unit 26 is utilized to advance the labeler 20 forward to the next row until the packaging machine system advances the next set of rows to the labelers' 20 home position. When the next set of rows is advanced, the shifting unit 26 would then return the labeler 20 to its home position to dispense labels 30 on the first row of articles 10 in that set.

To sense the presence or absence of an article 10, or an empty package 10, the present invention must have one sensor 60 for each article 10 in a row. Each sensor 60 is placed in front of the label transport 24, or upstream from the row being labeled by the transport 24, and must be positioned over the area where the respective article 10 in each row is expected to be traveling. Thus, for a row containing four articles 10, the label transport 24 must have four sensors 60 placed in front of the label transport 24 over the area where the four articles 10 are expected to travel.

The sensors 60 of the present invention are preferably placed over the top of the area where the articles 10 are to travel, or when the labeler 20 is inverted, the sensors 60 may be placed underneath the area where the articles 10 are to travel. Since the present invention is primarily designed for use in connection with articles 10 packaged in packaging film, the present invention employs capacitive sensors 60 that detect moisture, such as those sensors sold by Turck, Inc. Inductive sensors and the like may also be used in the present invention. Those skilled in the art will also appreciate that in labeling applications, where the packages are not wrapped in packaging film, other types of sensors may be used to accomplish the same advantages as those taught by the present invention for articles packaged in packaging film.

The sensors 60 of the present invention will produce signals, or become excited, when packaged articles 10 are positioned underneath the sensors 60. The capacitive sensors 60 detect the weak conductivity in the product due to moisture. Since the present application is designed primarily for use in connection with packaging food articles 10, the sensors 60 will detect the moisture contained in the food articles. Thus, when a food article 10 is absent, a sensor 60 will not signal the presence of a packaged article 10. This means that if a package 10 is absent or a package 10 is empty, the sensor 60 will not signal or become excited.

Since the sensors 60 are placed at least one row ahead of the row being labeled, the labeler 20 can call for a snapshot of the signals being given by the sensors 60 as they relate to the preceding row of articles 10. This snap-shot is taken before the labeler 20 advances over the relevant articles 10 and is stored into memory as a series of binary digits, ie., a status byte. If a sensor 60 detects a package article 10, i e., becomes excited, the sensor 60 was excited, a 1 will be stored into memory for that sensor 60, in a position in the series of bits that corresponds to the position of the sensor 60. In contrast, if a sensor 60 is not excited, meaning that the corresponding package 10 was either empty or absent, a 0 will be stored into memory in the position holder for that sensor 60.

Thus, if a snapshot of a row of four articles 10 is being taken, four bytes will be stored into memory relating to those four articles. If the representative status byte taken from a snapshot reads 1101, one knows that the third package 10 in the row contains either an empty package or the package is missing. The first bit in the status byte will correspond to the positioning of the first article 10 in the row to be labeled, which is the first label 30 to be dispensed. The labeler 20 can then take this information and use it to determine when and when not to call for a label 30 to be dispensed.

Figure 7:
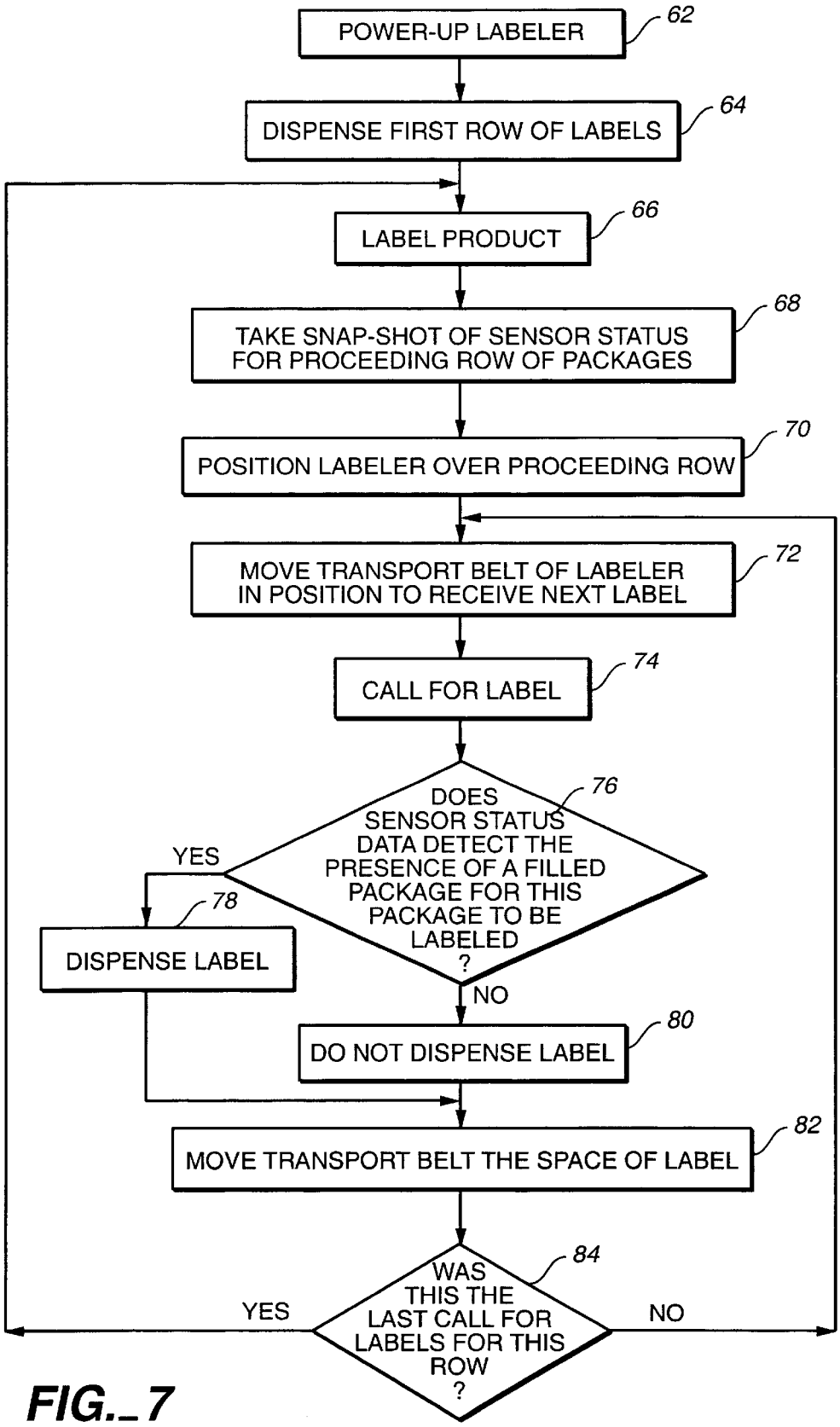
FIG. 7 is a flow chart of the preferred process for controlling the operation of the labeling machine when used to apply labels in accordance with the present invention.

As illustrated by the flow chart in FIG. 7, in operation, the labeler 20 is first powered on (step 62), and, based upon the parameters input by the user, such as labels 30 per row, row distance, and row spread, and those measured by the label scanner 42, the labeler 20 will determine where to position the labels 30 on the label transport belt and the spacing between the labels 30. Based on these initial parameters, the labeler 20 will dispense the first row of labels 30 (step 64) and place the labels 30 on the packaged articles 10 positioned directly underneath the labeler 20, using the tamper blades 48 (step 66). A snapshot of the sensors 60 positioned over the preceding row (step 68), as described above, is then taken, which produces a status byte representing the packaged articles 10 in the preceding row. The label transport 24 is then either moved, via the shifting unit 26 over to the preceding row, or the packaging machine system moves the articles 10 to position them underneath the label transport 24 (step 70). The label transport 24 then moves the belt in position to receive the first label (step 72). The label transport 24 then sets an I/O bit high to call for the label dispenser 22 to dispense the first label 30 (step 74). In the present invention, the I/O bit is set to a 1 when it is set high. Prompted by this call, the label transport 24 then performs an internal AND compare function on the first bit of the status byte retrieved from the snapshot of the row of articles now positioned below the label transport 24.

The transport 24 now begins moving the belt the first label distance. If the sensor 60 indicated the presence of an article 10, which would return the AND compare function as (1 AND 1=1), then the signal is fed to the label dispenser 22 to dispense a label 30 (steps 76 and 78). If the sensor 60 did not indicate the presence of an article 10, which would return the AND compare function as (1 AND 0=0), then no signal is fed to the label dispenser 22 (step 80). The transport 24 will then move the belt the space of the label 30 (step 82), regardless of whether a label 30 is dispensed. If there are more labels to be dispensed for that row (step 84), the transport 24 now advances the belt creating a space between the labels 30 (step 72), performs a right shift on the status byte which brings the status of the second sensor 60 into the least significant bit and starts the process all over again with setting the I/O bit high to initiate the next call for a label 30 from the label dispenser 22 (step 84).

Thus, the process of setting the I/O bit high to call for a label 30 from the label dispenser 22, performing the internal AND compare function, and determining whether to send the call to the dispenser 22, is repeated over and over again for each label 30 in the row. After the call for the last label 30 in the row (step 84), the label dispenser 24 then labels the product for that row using the tamper blades 48 (step 66) and calls for a snapshot of the preceding row (step 68), the labeler 20 advances to that row (or the packaging machine advances to align the articles 10 underneath the labeler 20) (step 70) and the call process begins again with a new status byte of information for the row beneath the label transport 24 (step 74).

Although the foregoing detailed description of the present invention has been described by reference to a single exemplary embodiment, and the best mode contemplated for carrying out the present invention has been herein shown and described, it will be understood that modifications or variations in the structure and arrangement of this embodiment other than those specifically set forth herein may be achieved by those skilled in the art and that such modifications are to be considered as being within the overall scope of the present invention.

For example, as previously discussed, this invention can be used in a variety of labeling applications by modifying the type of sensors 60 used in connection with the labeling machine 20. Likewise, in the present invention the sensors 60 are mounted to the labeler 20 or positioned one row preceding the rows being labeled. The sensors 60 may, however, be positioned more than one row ahead of the labeler 20, making the status byte string longer. Furthermore, the number of sensors 60 used in the present invention will correspond to the number of articles 10 per row. Depending on the intelligence and memory capacity of each machine 20, the maximum amount of sensors 60 that can be used may vary and will be dictated by each particular labeling machine 20. Finally, the present invention teaches that when no label 30 is dispensed, the label transport 24 first moves the distance of the label 30 and then moves to create a space between the labels 30—a two-step process. The labeler 20 could alternatively be programmed such that if a label 30 is not dispensed, the labeler 20 will move the distance of the label 30 and the space between the label 30 in one movement, rather than maintaining a constant speed for the dispensing of the label 30 then accelerating to create the space between the labels 30.

As briefly described above, modifications other than those specifically set forth herein may be achieved by those skilled in the art. Such modifications are to be considered as being within the overall scope of the present invention. It is contemplated that the present invention shall cover any and all modifications, variations, or equivalents that fall within the true spirit and scope of the underlying principles disclosed and claimed herein. Consequently, the scope of the present invention is intended to be limited only by the attached claims.

I claim:

1. A labeling machine having the ability to detect the presence of either empty packages or the absence of packages on a packaging machine system, said labeling machine comprising at least one proximity sensor placed in front of the labeling machine to detect either the presence of empty packages or the absence of packages on a packaging machine prior to empty packages or empty spaces on the packaging machine reaching the labeling machine and to communicate such information to the labeling machine such that the labeling machine will not dispense labels for empty packages or absent packages on the packaging machine system.

2. A labeling machine recited in claim 1, wherein the labeling machine is designed to place labels on an array of packages on a multiple track packaging machine.

3. A labeling machine recited in claim 2, having at least one proximity sensor positioned over each track of the multiple track packaging machine.

4. A labeling machine recited in claim 1, wherein said sensors are capacitive proximity sensors.

5. A labeling machine recited in claim 1, wherein said sensors detect the conductivity in the product due to moisture contained in the product to be packaged.

6. A labeling machine recited in claim 1, wherein said sensors are placed at least one row ahead of a row of packages being labeled.

7. A method for detecting either empty packages or the absence of packages on a packaging machine system to prevent the unnecessary dispensing of labels onto empty and absent packages, said method comprising the steps of:

placing at least one sensor in front of a labeling machine to detect the presence of either empty packages or the absence of packages on a packaging machine system, the sensor communicating the detection of either an empty package or absence of a package to the labeling machine;

the labeling machine reading the communication and preventing the dispensing of a label for a package when the sensor has detected that a package for which a label is to be dispensed is either empty or absent.

8. A method for detecting an empty package or the absence of a package on a packaging machine system as recited in claim 7, wherein said method further includes placing at least one sensor over each track of a packaging machine system when utilizing a labeling machine for labeling an array of packages.

9. A method for detecting an empty package or the absence of a package on the packaging machine system as recited in claim 7, further comprising the step of utilizing multiple sensors and communicating the information detected by the sensors with respect to each package in an array of packages to the labeling machine in the order that the labeling machine dispenses the labels for such packages on the tracks of the packaging machine.

10. A method for detecting either empty packages or the absence of packages on a packaging machine system to prevent the unnecessary dispensing of labels onto empty and absent packages, said method comprising the steps of:

placing proximity sensors at least one row ahead of the row being labeled by a labeling machine designed to label an array of packages;

the labeled calling for a snap-shot of the signals being given by the sensors as they relate to the proceeding row of packages;

storing said snap-shot of signals as a series of bit information corresponding to the placement of each sensor;

the labeler reading the series of bit information when dispensing the row of labels that corresponds to the row of packages for which the information was taken and dispensing labels only when a sensor detects the presence of a package filled with product.

* * * * *

US006543505C1

(12) INTER PARTES REEXAMINATION CERTIFICATE (0177th)

United States Patent

Harte

(10) Number: US 6,543,505 C1

(45) Certificate Issued: Jul. 20, 2010

(54) EMPTY PACKAGE DETECTOR FOR LABELING APPARATUS

(75) Inventor: James R. Harte, Shawnee, KS (US)

(73) Assignee: Koch Equipment LLC, Kansas City, MO (US)

Reexamination Request:
No. 95/000,084, Mar. 21, 2005

Reexamination Certificate for:

| | |
|---|---|
| Patent No.: | **6,543,505** |
| Issued: | **Apr. 8, 2003** |
| Appl. No.: | **09/553,837** |
| Filed: | **Apr. 21, 2000** |

(51) Int. Cl.

| | |
|---|---|
| ***B65C 1/00*** | (2006.01) |
| ***B65C 1/02*** | (2006.01) |
| ***B65C 9/00*** | (2006.01) |
| ***B65C 9/42*** | (2006.01) |

(52) U.S. Cl. ..... 156/350; 156/362; 156/363; 156/540

(58) Field of Classification Search ..... 156/350, 156/351, 360, 361, 362, 363, 540, 541, 542, 156/556; 53/67, 135.1, 136.1, 52, 53, 54, 53/58, 498, 499, 500, 502, 503

See application file for complete search history.

(56) References Cited

U.S. PATENT DOCUMENTS

| | | | | |
|---|---|---|---|---|
| 4,025,382 A | | 5/1977 | Del Rosso | |
| 4,345,167 A | * | 8/1982 | Calvin | 327/517 |
| 4,472,922 A | | 9/1984 | Romagnoli | |
| 4,558,755 A | | 12/1985 | Lundin | |
| 4,585,506 A | | 4/1986 | Matsuguchi | |
| 4,691,496 A | * | 9/1987 | Anderson et al. | 53/53 |
| 5,400,838 A | * | 3/1995 | Schjerven et al. | 141/174 |
| 5,623,816 A | | 4/1997 | Edwards | |
| 6,295,881 B1 | * | 10/2001 | Stewart et al. | 73/866.5 |
| 6,523,328 B1 | * | 2/2003 | De Cardenas et al. | 53/399 |

OTHER PUBLICATIONS

1986 Safeway Machine Documentation.
Article from Packmarknaden Scandinavia.
BL Production AB Product Brochure.
1986 Telex Transmission between BL Production AB and Koch Supplies, Inc.

* cited by examiner

*Primary Examiner*—Ovidio Esclanate

(57) ABSTRACT

A method and apparatus for communicating with a multiple lane labeling machine such that the labeling machine will only dispense and place labels on packaged articles. The present invention comprises a labeling machine having sensors positioned in front of the label transport, which positions the labels on the packaged articles. These sensors are preferably positioned directly in front of the label transport over the row of articles preceding the transporter and operate to detect the presence and absence of packaged articles and their content. Thus, if a package is absent from a row or does not contain product the sensors alert the labeling machine of the absence of an article so that the labeler does not dispense a label for a missing article or empty package.

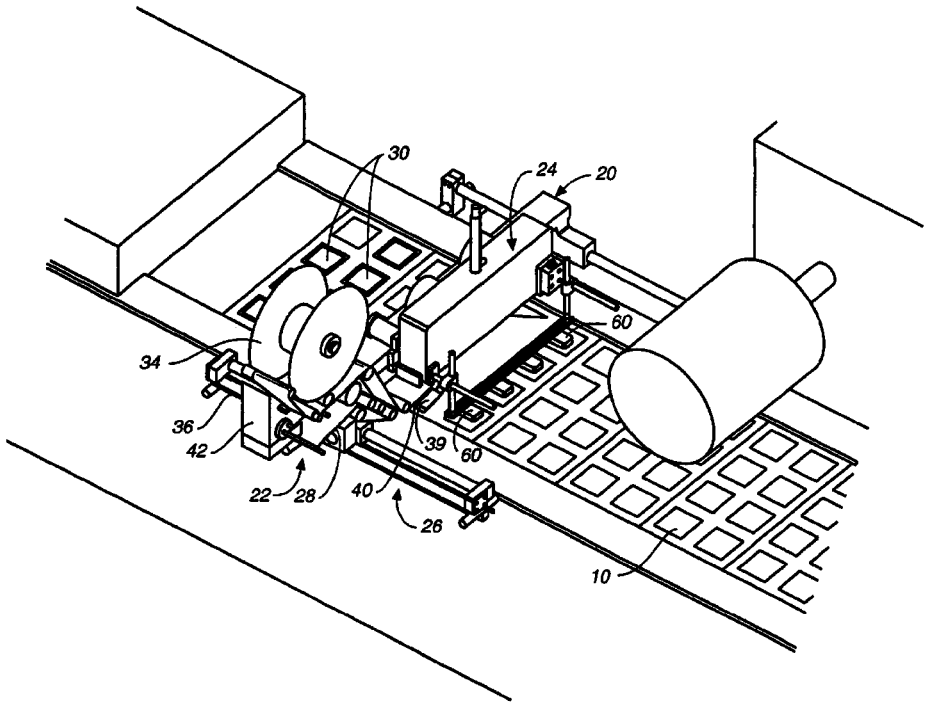

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 7 and 10 are determined to be patentable as amended.

Claims 2-6, 8 and 9, dependent on an amended claim, are determined to be patentable.

New claims 11-32 are added and determined to be patentable.

1. A labeling machine having the ability to detect the presence of either empty packages or the absence of packages on a packaging machine system, *said system advancing a stream of packages, including empty and absent packages, toward and through said labeling machine,* said labeling machine comprising at least one proximity sensor placed in front of the labeling machine to detect either the presence of empty packages or the absence of packages on a packaging machine prior to empty packages or empty spaces on the packaging machine reaching the labeling machine and to communicate such information to the labeling machine such that the labeling machine will not dispense labels for empty packages or absent packages on the packaging machine system, *so that said empty and absent packages pass through the labeling machine without receiving labels.*

7. A method for detecting either empty packages or the absence of packages on a packaging machine system to prevent the unnecessary dispensing of labels onto empty and absent packages, *said system advancing a stream of packages, including empty and absent packages, toward and through said labeling machine,* said method comprising the steps of:

placing at least one sensor in front of a labeling machine to detect the presence of either empty packages or the absence of packages on a packaging machine system, the sensor communicating the detection of either an empty package or absence of a package to the labeling machine;

the labeling machine reading the communication and preventing the dispensing of a label for a package when the sensor has detected that a package for which a label is to be dispensed is either empty or absent, *so that said empty and absent packages pass through the labeling machine without receiving labels.*

10. A method for detecting either empty packages or the absence of packages on a packaging machine system to prevent the unnecessary dispensing of labels onto empty and absent packages, *said system advancing a stream of packages, including empty and absent packages, toward and through said labeling machine,* said method comprising the steps of:

placing proximity sensors at least one row ahead of the row being labeled by a labeling machine designed to label an array of packages;

the labeler calling for a snap-shot of the signals being given by the sensors as they relate to the proceeeding row of packages;

storing said snap-shot of signals as a series of bit information corresponding to the placement of each sensor;

the labeler reading the series of bit information when dispensing the row of labels that corresponds to the row of packages for which the information was taken and dispensing labels only when a sensor detects the presence of a package filled with product,

*so that said empty and absent packages pass through the labeling machine without receiving labels.*

*11. A labeling machine recited in claim 1, wherein the labeling machine extends above or below the packages to be labeled.*

*12. A labeling machine recited in claim 2, wherein the array of packages moves along an axis of travel and wherein the labeling machine extends above or below the packages to be labeled and applies labels in a direction that is generally perpendicular to the axis of travel of the packages.*

*13. A labeling machine recited in claim 1, the labeling machine further comprising a label dispensing mechanism and a label transport and tamping mechanism.*

*14. A labeling machine recited in claim 13, wherein operation of the label dispensing mechanism is controlled by a first microprocessor and operation of the label transport and tamping mechanism is controlled by a second microprocessor.*

*15. A labeling machine recited in claim 13, wherein the label dispensing mechanism and the label transport and tamping mechanism are each driven by a stepper motor.*

*16. A labeling machine recited in claim 1, wherein the packages are formed from at least one continuous web of material.*

*17. A labeling machine recited in claim 1, wherein the packaging machine system is a form, fill, and seal system.*

*18. A labeling machine for use in a form, fill and seal packaging system, said system advancing a stream of packages, including empty and absent packages, toward and through said labeling machine, said labeling machine comprising:*

*a label dispensing mechanism for dispensing labels;*

*a label transport and tamping mechanism for positioning the labels on an array of packages formed from a continuous web of material; and*

*a plurality of sensors positioned in front of the label transport and tamping mechanism for detecting either the presence of empty packages or missing packages from the array of packages prior to the packages reaching the label transport and tamping mechanism and to communicate such information to the label dispensing mechanism so that the label dispensing mechanism does not dispense labels for the empty packages or missing packages, and so that said empty and absent packages pass through the labeling machine without receiving labels.*

*19. A labeling machine recited in claim 18, wherein said sensors are capacitive proximity sensors.*

*20. A labeling machine recited in claim 18, wherein said sensors detect the conductivity in product in the packages due to moisture contained in the product to be packaged.*

*21. A labeling machine recited in claim 18, wherein the labeling machine extends above or below the packages to be labeled.*

*22. A labeling machine recited in claim 18, the labeling machine further comprising a label shifting unit.*

*23. A labeling machine recited in claim 18, wherein operation of the label dispensing mechanism is controlled by a first microprocessor and operation of the label transport and tamping mechanism is controlled by a second microprocessor.*

*24. A labeling machine recited in claim 23, wherein the label dispensing mechanism and the label transport and tamping mechanism are each driven by a stepper motor.*

*25. A form, fill, and seal packaging system comprising:*

*a packager for creating an array of product packages from a least one continuous web of material, for filling the packages with product, and for advancing said array of product packages, including empty and absent packages, toward and through a labeling machine; and*

*a labeling machine for labeling the array of product packages, the labeling machine including:*

*a label transport and tamping mechanism for positioning labels on the array of product packages; and*

*a plurality of sensors positioned in front of the label transport and tamping mechanism for detecting either the presence of empty packages or missing packages from the array of product packages prior to the product packages reaching the label transport and tamping mechanism and to communicate such information to the label transport and tamping mechanism so that the label transport and tamping mechanism does not dispense labels for the empty product packages or missing product packages, and so that said empty and absent packages pass through the labeling machine without receiving labels.*

*26. The form, fill, and seal packaging system recited in claim 25, wherein said sensors are capacitive proximity sensors.*

*27. The form, fill and seal packaging system recited in claim 25, wherein said sensors detect the conductivity in the product due to moisture contained in the product to be packaged.*

*28. The form, fill, and seal packaging system recited in claim 25, wherein said sensors are placed at least one row ahead of a row of packages being labeled.*

*29. The form, fill, and seal packaging system recited in claim 25, wherein the labeling machine extends above or below the packages to be labeled.*

*30. The form, fill, and seal packaging system recited in claim 25, the labeling machine further comprising a label dispensing mechanism.*

*31. The form, fill, and seal packaging system recited in claim 25, wherein operation of the label dispensing mechanism is controlled by a first microprocessor and operation of the label transport and tamping mechanism is controlled by a second microprocessor.*

*32. The form, fill, and seal packaging system recited in claim 25, wherein the label dispensing mechanism and the label transport and tamping mechanism are each driven by a stepper motor.*

* * * * *